US005398644A

United States Patent [19]

Nilsson et al.

[11] Patent Number: 5,398,644

[45] Date of Patent: Mar. 21, 1995

[54] TEMPERATURE MEASUREMENT AT EVAPORATOR OUTLET

[75] Inventors: Karl-Johan Nilsson; Stefan Schill, both of Finspong, Sweden

[73] Assignee: ABB Carbon AB, Finspong, Sweden

[21] Appl. No.: 204,349

[22] PCT Filed: Aug. 25, 1992

[86] PCT No.: PCT/SE92/00582

§ 371 Date: Mar. 11, 1994

§ 102(e) Date: Mar. 11, 1994

[87] PCT Pub. No.: WO93/06416

PCT Pub. Date: Apr. 1, 1993

[30] Foreign Application Priority Data

Sep. 13, 1991 [SE] Sweden ..... 9102653

[51] Int. Cl.[6] ..... F22D 7/00

[52] U.S. Cl. ..... 122/406.4; 122/451.1; 122/479.7

[58] Field of Search ..... 122/451, 451.1, 451 S, 122/479.7, 406.4

[56] References Cited

U.S. PATENT DOCUMENTS 2,800,887 7/1957 Profos ..... 122/451.1

3,004,529 10/1961 Argersinger et al. ..... 122/451.1

5,037,766 5/1994 Pearce ..... 122/406.4

FOREIGN PATENT DOCUMENTS 1551447 7/1970 Germany .

*Primary Examiner*—Henry C. Yuen

*Attorney, Agent, or Firm*—Pollock, Vande Sande & Priddy

[57] ABSTRACT

A method and a device for temperature measurement of the fluid at the outlet from an evaporator in a boiler of benson type, wherein the evaporator includes one or more inlet headers which are supplied with water passed on to evaporator tubes which communicate with a heat-transferring medium and wherein the water is transformed into a fluid which is then via evaporator stubs passed to one or more outlet headers of the evaporator, the temperature of the fluid being measured with the aid of temperature sensors which are placed on adjacently located evaporator stubs for a number of important and critical parts of the boiler, the measured values for each part being supplied to median value selectors whereafter each median value is supplied to a maximum selector, whereby the maximum temperature ($t_{max}$) of any of the outlets from the evaporator is obtained, and to a means temperature ($t_{mean}$) of the fluid at the outlet of the evaporator is obtained.

6 Claims, 1 Drawing Sheet

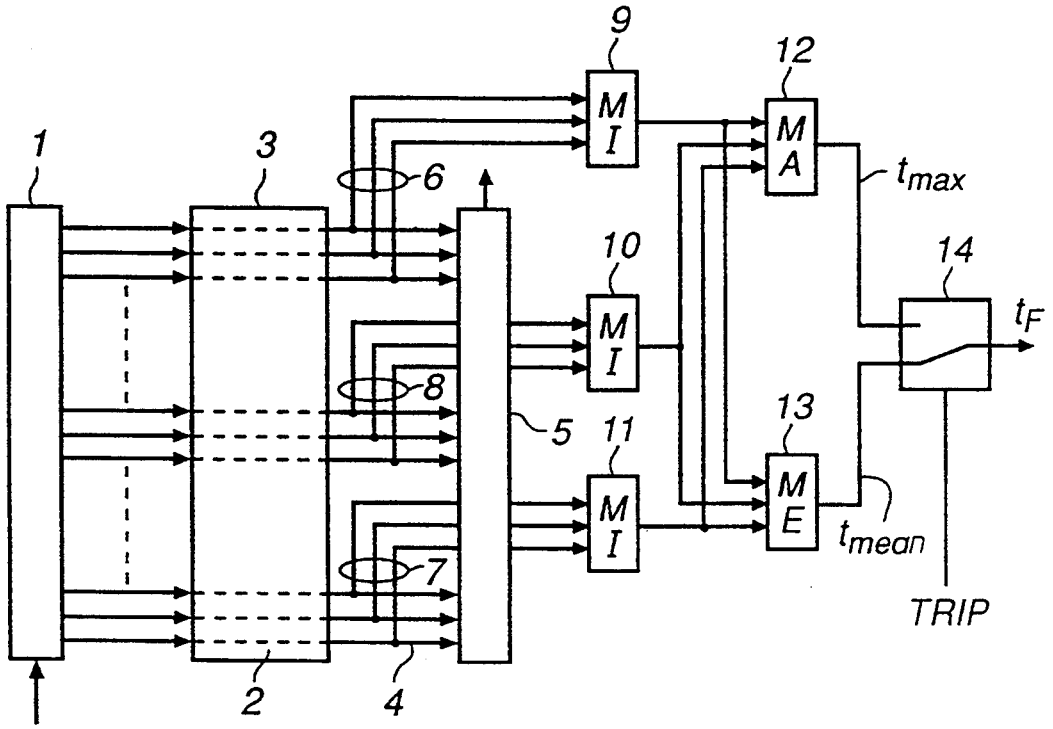
1
2
3
4
5
6
7
8
9
10
11
12
13
14
M I
M I
M I
M A
M E
$t_{max}$
$t_{mean}$
$t_F$
TRIP

TEMPERATURE MEASUREMENT AT EVAPORATOR OUTLET

FIELD OF THE INVENTION

The technical field to which this invention relates is temperature measurement of the fluid at the outlet from the evaporator in a once-through boiler of so-called benson type. The invention comprises a method for such measurement and a device for carrying out the method.

BACKGROUND OF THE PRESENT INVENTION

A benson boiler comprises an economizer, an evaporator, a steam/water separator, a number of usually two, superheaters and an intermediate steam cooler as well as possibly one or more reheaters with associated steam coolers.

Benson boilers exist in a number of different designs. Most common in existing plants is that the evaporator consists of membrane walls which constitute the walls of a furnace. At the top of this furnace a flue gas channel starts which passes the flue gases to the chimney. At the very transition from furnace to flue gas channel, radiation superheaters are located, the main heat absorption of which consists of radiation from the flames in the furnace. Behind the radiation superheaters inside the flue gas channel, convection superheaters are located, which take up the main part of the heat via convection. Further towards the interior of the flue gas channel, where the flue gas temperature is lower, the economizer is placed. In this type of plants, the fuel is injected either in finely-divided form via special burners, whereby it is finally burnt freely floating in the furnace, or it is injected in larger lumps on a firing grate at the bottom of the furnace, whereby the volatile constituents escape and are burnt in the furnace whereas the solid constituents are burnt down on the firing grate.

Recently it has become increasingly more common to use so-called fluidized bed boilers where the main combustion of the fuel takes place in a bed consisting of absorbent and ashes. The bed is enclosed in a bed vessel built up of membrane walls in the same way as the furnace in a conventional boiler. The combustion air is supplied from below through a number of air nozzles, which causes the bed to become fluidized. At a moderate gas speed in the bed vessel, the particles will remain and a so-called bubbling bed is obtained. At higher gas speeds, the particles will accompany the gas and are separated in cyclones so that they can be returned to the bed vessel. The latter is called a circulating fluidized bed. The pressure in the bed may in some cases be considerably higher than the atmospheric pressure. One example of this are the so-called PFBC steam boilers in which a gas turbine uses a pressurized fluidized bed boiler as combustor. Common to the fluidized bed boilers is that the heat surfaces, that is, economizer, evaporator, superheaters and reheaters, are at least partly located in the bed itself. The PFBC boilers constitute an extreme case since the entire evaporator, superheater and reheater surfaces consist of one tube bundle placed in the bed whereas the bed vessel wall is almost to be compared to an economizer. Atmospheric fluidized bed boilers are more like a conventional boiler since the bed vessel wall constitutes part of the evaporator and the superheaters are at least partly located in the convection parts downstream of the bed vessel.

A benson boiler operates in the following way. Feedwater is supplied to the economizer where its temperature is raised. At the outlet from the economizer there should be a certain margin with respect to the boiling point. From the economizer the water is supplied to the evaporator where it is evaporated completely and superheated somewhat. The slightly superheated steam is passed via the steam/water separator to a first superheater where the temperature of the steam is raised. After the first superheater the steam passes through a first controllable steam cooler where the steam is cooled somewhat before it is raised to the desired final temperature in a second superheater. After that, the steam is passed to a high-pressure turbine after which it is returned to the reheater of the boiler via a second controllable steam cooler. In the reheater the temperature of the steam is again raised to the desired final temperature before it is finally expanded through an intermediate-pressure turbine and a low-pressure turbine. In certain boilers there may be more than two superheaters and there may also be more reheaters. In the boiler described here, it is assumed that all the steam is used for driving a turbine. In other applications there may be other steam consumers, such as chemical industries or district heating networks.

The feedwater flow must be varied with the load for the steam condition at the evaporator outlet to be maintained. Because of the risk of high local temperatures in the evaporator tubes, however, the feedwater flow must not be lower than a so-called minimum flow, which normally constitutes 25–40% of the feedwater flow at full load. This means that at low loads and during start-up, the condition at the evaporator outlet will consist of a mixture of water and steam. It is during these low loads that the steam/water separator is used to separate the water from the steam so as to avoid the ingress of water into the superheaters. The operating point where the change from having a water/steam mixture in the evaporator outlet to having superheated steam in the evaporator outlet, or vice versa, is made is called the benson point. In some boilers it may be necessary to have several different minimum flows. It is possible, for example, to have one minimum flow during start-up and normal operation whereas, after a trip, another minimum flow may be necessary.

Steam coolers are used for controlling the temperature after superheaters and reheaters. Usually, a steam cooler is designed as a spray nozzle through which water is sprayed into the steam.

The control of a once-through boiler is normally performed such that a main boiler control supplies a load signal to the feedwater control, the fuel control and the air control. These then control the primary feedwater flow, the fuel flow and the air flow according to built-in set values which are given as a function of the load signal. However, the respective control circuit also includes limiting controls. Thus, for example, the feedwater control has a built-in limiting control which ensures that the flow is not lower than the minimum flow, and other limiting controls adjust the feedwater flow if the control deviation in the fuel control or the air control becomes too great. There is usually also a limiting control which adjusts the feedwater flow if the spray flow in any of the steam coolers becomes too great or too small. This latter limiting control is actually a way of adjusting the feedwater flow in those cases where the reality deviates from the built-in relationship between load signal, air flow, fuel flow and the required feedwater flow. In those cases where this relationship is uncertain, for example because it changes with disturbances in the process, limiting controls may be introduced which adjust the feedwater flow also if the temperature at certain points in the boiler deviates too much from the desired values. Examples of such points are the inlet and outlet of the evaporator and also the outlet of the superheaters.

In certain cases the principle of primary control of the feedwater flow as a function of a load signal is abandoned. Instead, the set value of the feedwater flow is determined directly from the measurement of the steam condition in the different parts of the boiler. The advantage of this is that the above-mentioned uncertainty in connection with disturbances in the process is eliminated, since the boiler at each moment states exactly how much water it needs independently of what happens with the surroundings. The disadvantage is that inertia phenomena in the process and in transducers, and above all in temperature meters, may cause the information about a changed need of feedwater flow to be delayed. For this reason, increased demands are placed on the speed of action and the location of the transducers and on the speed of action of the controls.

Irrespective of which of the above-mentioned concepts is selected, it may be desirable to measure the temperature at the evaporator outlet. If this temperature measurement is to be fast, which is of the utmost importance when the last-mentioned of the above concepts is concerned, the temperature measurement should be performed as close to the evaporator outlet as possible. In view of this point, therefore, the temperature sensor should be placed in the steam pipe as close to the outlet of the evaporator as possible. However, the flow distribution in the evaporator is seldom uniform. This means that the steam at the outlet from certain tubes may have a relatively high superheat whereas the state in other tubes may only be slightly superheated. Certain tubes may even have a water/steam mixture at the outlet in certain operating cases in spite of the fact that the benson point is exceeded. Superheated steam with different temperatures is reluctant to mix with each other, and therefore layers with different temperatures, which are maintained for rather a long distance, may arise. If water is released from certain evaporator tubes, it takes time before the water is evaporated. In addition, the water has a tendency to follow the pipe walls and may therefore end up on the temperature measuring pocket, whereby the temperature sensor records the saturation temperature in spite of the fact that the steam during the mixing is clearly superheated. To sum up, it can thus be said that if the temperature sensor is placed near the outlet of the evaporator to obtain a fast measurement, there is a risk of poor reliability because of measurement errors.

One way of increasing the reliability of the temperature measurement at the evaporator outlet is to place the temperature sensor in the steam pipe downstream of the separator. This minimizes the risk of water droplets entering the measuring pocket while at the same time the turbulence in the separator reduces the risk of layers of steam with different temperatures. One of the disadvantages is that the temperature measurement becomes slower since the temperature sensor is placed further from the evaporator. This is particularly noticeable at low loads when the steam flow is small. Another disadvantage is that if the power supply on the gas side is rapidly decreased to a low value, for example because of a trip, then an awkward measurement error may occur which causes the control to get into a "vicious circle". The phenomenon may be described as follows: Let it be assumed that the feedwater control because of inertia at the temperature measuring points does no have time to decrease the flow sufficiently rapidly. It may then happen that the new power supply from the gas side to the evaporator is not sufficient to raise the enthalpy of the water to the saturation point. The result is that subcooled water flows out from the evaporator into the separator where it starts condensing the steam which is present there. The pressure reduction which arises causes the steam to rush backwards through the superheaters to the separator. The hot steam from the superheaters thereby passes the temperature measuring point after the separator, which makes the feedwater control believe that there is a shortage of water. The feedwater control therefore increases the flow, which accelerates the process. If there is a boiler where the superheaters are subjected to high temperatures also after a trip, the decreasing cooling steam flow through these superheaters may cause damage.

In the above-mentioned example, it is always possible, by feed forward control, to force the feedwater flow to decrease sufficiently rapidly and to a sufficient extent to maintain the steam production in the evaporator. In this way, the cooling requirement of the superheaters may be satisfied. If at the same time there is a requirement for cooling the evaporator, however, the flow must be optimized such that it is neither too small nor too great. In view of the cooling requirement of the superheater, the feedwater flow should be as low as possible. If the lower limit to what is acceptable for the evaporator is assumed, however, it is important to provide a feedback by measuring the temperature in the evaporator outlet such that the control is able to increase the feedwater flow when required. If the temperature measuring point is located downstream of the separator, it will be too slow to be used for control considering the small steam flows prevailing after a trip.

As will have been clear from the above, it is thus desirable to be able to measure the temperature at the evaporator outlet in a way which is both rapid and reliable. It is also important to be able to measure the temperature within parts of the boiler and the evaporator outlet which are important and critical for the process, such as, for example, at the outer edges of the boiler and in the central zone.

SUMMARY OF THE INVENTION

To be able to describe the invention, a short description of the configuration of an evaporator will first be given with reference to the accompanying single FIGURE. The heated water from the economizer is passed to one or more evaporator inlet headers 1 in the evaporator from where the water is passed into the evaporator tubes 2 which communicate with a heat-transferring medium 3. The number of evaporator tubes in a plant are determined by a number of factors such as what kind of boiler it is, design power, etc. After the evaporation the steam is passed via evaporator stubs 4 to one or more outlet headers 5 and is then passed on to a separator (not shown).

The condition at the outlet of each individual tube, which consists of a relatively thin-walled tube, is unambiguously either subcooled, saturated or superheated. By applying thermocouples or resistance thermometers on a number of well selected evaporator stubs, a measure of the temperature is obtained, which temperature conforms very well to the temperature of the fluid inside the tube. This makes it possible also to detect the state of the fluid.

According to the invention, the temperature of the fluid is measured by applying thermocouples on a number of adjacently positioned evaporator stubs for each important and critical part of the boiler. By finding out the median value within each part, redundancy is obtained if any measuring point should drop out. The median values obtained for the chosen parts of the evaporator can now either be used for calculating the mean state in the evaporator outlet or for calculating the state in that part of the boiler which has the greatest need of feedwater.

With the aid of the produced median values for each part, the mean value of the temperature in the evaporator can be determined. Within the normal load range, the mean value gives the best measure of the temperature of the fluid since the heat load on the evaporator tubes is then relatively uniform in the whole boiler. After a trip, on the other hand, it may be more suitable to use the maximum value since the heat load can then vary to a greater extent between the parts of the evaporator. When making such decisions, it is, of course, necessary in each individual case to take into account the properties and design of the current boiler.

A preferred embodiment of the invention is also shown in the accompanying FIGURE. Thermocouples or resistance thermometers 6 and 7 are here placed on three evaporator legs near the outer edges of the evaporator, and thermocouples or resistance thermometers 8 are placed on three evaporator legs at the center of the evaporator. The FIGURE also shows three median value selectors 9, 10 and 11, the values of which can then be used for selection of the maximum temperature $t_{max}$ of the evaporator outlets in a maximum selector 12, or for determining the mean value of the temperature, $t_{mean}$, at the evaporator outlet in a mean value generator 13. Switching between these measured values in connection with a trip can, for example, be performed with a selector 14 whose output signal constitutes the temperature $t_F$ in question.

We claim:

1. A method for measuring temperature of the fluid at an outlet from an evaporator in a once-through boiler of benson type, which evaporator includes one or more inlet headers supplied with water which is passed on to evaporator tubes which communicate with a heat-transferring medium, wherein the water in the evaporator tubes is transformed into a fluid which may either be subcooled, saturated or superheated and which is then passed via evaporator stubs to one or more outlet headers of the evaporator, said method comprising the steps of:

measuring the temperature of the fluid with the aid of temperature sensors which are placed on adjacently located evaporator stubs for a number of important and critical parts of the boiler;

supplying the measured temperature values for each part to median value selectors, and supplying each median value to a maximum selector, to obtain the maximum temperature ($t_{max}$) of some of the outlets from the evaporator and to a mean value generator to obtain the mean temperature ($t_{mean}$) of the fluid at the outlet of the evaporator.

2. A method for measuring temperature according to claim 1, wherein said temperature sensors include thermocouples or resistance thermometers which are placed on adjacently located evaporator stubs, at the two outer edges of the evaporator and at the center of the evaporator.

3. A method for measuring temperature according to claim 1, wherein said temperature sensors include thermocouples or resistance thermometers which are placed on three evaporator stubs, at the two outer edges of the evaporator at the center of the evaporator.

4. A device for measuring temperature of the fluid at an outlet from an evaporator in a once-through boiler of benson type, the evaporator having one or more inlet headers, evaporator tubes, evaporator stubs and one or more outlet headers, the temperature measuring device including:

sensors for measuring the temperature of the fluid, which are placed on adjacently located evaporator legs for a number of important and critical parts of the boiler; median value selectors for receiving measured temperature values for each part as input signals to the median value selectors, and for supplying the output signals of the median value selectors both as input signals to a maximum value selector, which delivers a signal corresponding to the maximum temperature ($t_{max}$) of any of the outlets from the evaporator, and as input signals to a mean value generator which delivers a signal corresponding to the mean temperature ($t_{mean}$) of the fluid at the outlet of the evaporator.

5. A device for measuring temperature according to claim 4, wherein said temperature sensors are thermocouples or resistance thermometers arranged on adjacently located evaporator stubs, at the two outer edges of the evaporator and at the center of the evaporator.

6. A device for measuring temperature according to claim 4, wherein said temperature sensors are thermocouples or resistance thermometers arranged on three evaporator stubs, at the two outer edges of the evaporator and at the center of the evaporator.

* * * * *